US008920670B2

(12) United States Patent
Harada et al.

(10) Patent No.: US 8,920,670 B2
(45) Date of Patent: Dec. 30, 2014

(54) MAGNETIC MATERIALS, METHODS OF MANUFACTURING MAGNETIC MATERIAL, AND INDUCTOR ELEMENT USING MAGNETIC MATERIAL

(75) Inventors: Koichi Harada, Tokyo (JP); Tomohiro Suetsuna, Kanagawa (JP); Toshihide Takahashi, Kanagawa (JP); Seiichi Suenaga, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 129 days.

(21) Appl. No.: 13/597,989

(22) Filed: Aug. 29, 2012

(65) Prior Publication Data

US 2013/0228717 A1 Sep. 5, 2013

(30) Foreign Application Priority Data

Aug. 31, 2011 (JP) ..... 2011-189071

(51) Int. Cl.

| | |
|---|---|
| ***B22F 1/02*** | (2006.01) |
| ***H01F 1/01*** | (2006.01) |
| ***H01F 1/26*** | (2006.01) |
| ***H01F 1/33*** | (2006.01) |
| *H01F 41/02* | (2006.01) |

(52) U.S. Cl.

CPC .. *H01F 1/01* (2013.01); *H01F 1/26* (2013.01); *H01F 1/33* (2013.01); *H01F 41/0246* (2013.01); *B22F 2999/00* (2013.01); *C22C 2202/02* (2013.01)

USPC ..... 252/62.55; 252/62.51 R; 252/62.51 C; 252/62.56; 252/62.57; 252/62.58; 252/62.59; 252/62.6; 252/62.62; 252/62.63; 252/62.64

(58) Field of Classification Search

USPC ..... 252/62.51 R, 62.51 C, 62.53–62.64

See application file for complete search history.

(56) References Cited

U.S. PATENT DOCUMENTS

| | | | | |
|---|---|---|---|---|
| 6,110,399 | A * | 8/2000 | McArdle et al. | 252/513 |
| 2008/0029300 | A1 | 2/2008 | Harada et al. | |

(Continued)

FOREIGN PATENT DOCUMENTS

| | | |
|---|---|---|
| JP | 06-089827 A | 3/1994 |
| JP | 8-20801 | 1/1996 |

(Continued)

OTHER PUBLICATIONS

Combined Chinese Office Action and Search Report issued Jul. 1, 2014 in Patent Application No. 201210320274.X (with English language translation).

Office Action issued May 27, 2014 in Japanese Patent Application No. 2011-189071 (with English language translation).

*Primary Examiner* — Carol M Koslow

(74) *Attorney, Agent, or Firm* — Oblon, Spivak, McClelland, Maier & Neustadt, L.L.P.

(57) ABSTRACT

A magnetic material of an embodiment includes: first magnetic particles that contain at least one magnetic metal selected from the group including Fe, Co, and Ni, are 1 μm or greater in particle size, and are 5 to 50 μm in average particle size; second magnetic particles that contain at least one magnetic metal selected from the group including Fe, Co, and Ni, are smaller than 1 μm in particle size, and are 5 to 50 nm in average particle size; and an intermediate phase that exists between the first magnetic particles and the second magnetic particles.

17 Claims, 3 Drawing Sheets

(56) References Cited

U.S. PATENT DOCUMENTS

| | | | | |
|---|---|---|---|---|
| 2008/0220231 | A1 | 9/2008 | Suetsuna et al. | |
| 2009/0242826 | A1* | 10/2009 | Harada et al. | 252/62.55 |
| 2009/0302512 | A1* | 12/2009 | Gablenz et al. | 264/612 |
| 2010/0000769 | A1 | 1/2010 | Ohmi et al. | |
| 2010/0060538 | A1 | 3/2010 | Suetsuna et al. | |
| 2010/0060539 | A1 | 3/2010 | Suetsuna et al. | |
| 2011/0217543 | A1 | 9/2011 | Suetsuna et al. | |
| 2012/0038532 | A1 | 2/2012 | Yonetsu et al. | |
| 2012/0049100 | A1 | 3/2012 | Yonetsu et al. | |

FOREIGN PATENT DOCUMENTS

| | | | |
|---|---|---|---|
| JP | 2001-358493 | A | 12/2001 |
| JP | 2004-143347 | | 5/2004 |
| JP | 2006-179621 | A | 7/2006 |
| JP | 2008-311255 | | 12/2008 |
| JP | 2009-054709 | A | 3/2009 |
| JP | 2009-267221 | A | 11/2009 |

* cited by examiner

MAGNETIC MATERIALS, METHODS OF MANUFACTURING MAGNETIC MATERIAL, AND INDUCTOR ELEMENT USING MAGNETIC MATERIAL

CROSS-REFERENCE TO RELATED APPLICATION

This application is based upon and claims the benefit of priority from Japanese Patent Application No. 2011-189071, filed on Aug. 31, 2011, the entire contents of which are incorporated herein by reference.

FIELD

Embodiments described herein relate generally to magnetic materials, methods of manufacturing a magnetic material, and an inductor element using a magnetic material.

BACKGROUND

At present, magnetic materials are very important materials that are used in various device components such as inductor elements, electromagnetic wave absorbers, magnetic inks, and antenna devices. Those components utilize the characteristics of the real part of the magnetic permeability (the real part of the relative magnetic permeability) μ' or the imaginary part of the magnetic permeability (the imaginary part of the relative magnetic permeability) μ" of a magnetic material, in accordance with purposes. For example, inductor elements and antenna devices utilize high μ' (and low μ"), and electromagnetic wave absorbers utilize high μ". Therefore, when such components are actually used in devices, μ' and μ" need to be controlled in accordance with the frequency band used in each apparatus.

In recent years, higher frequency bands are used in apparatuses, and there is a pressing need to develop a magnetic material that has high μ' and low μ" in high-frequency regions and exhibit excellent characteristics.

DETAILED DESCRIPTION

Figure 1:
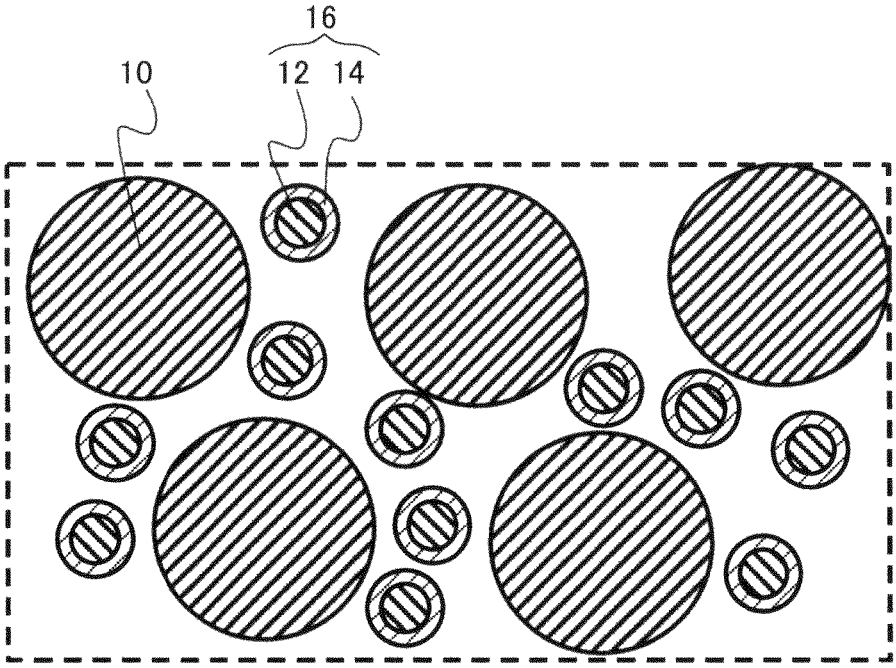
FIG. 1 is a schematic view of a magnetic material according to a first embodiment.

A magnetic material of this embodiment includes: first magnetic particles that contain at least one magnetic metal selected from the group including Fe, Co, and Ni, are 1 μm or greater in particle size, and are 5 to 50 μm in average particle size; second magnetic particles that contain at least one magnetic metal selected from the group including Fe, Co, and Ni, are smaller than 1 μm in particle size, and are 5 to 50 nm in average particle size; and an intermediate phase that exists between the first magnetic particles and the second magnetic particles.

In recent years, information and communication apparatuses have been becoming smaller and lighter with a rapid increase in the amount of information being exchanged. Specifically, the mobile communication terminals have been realized to become smaller and lighter so as to enhance convenience thereof. However, supply systems such as AC adaptors attached to those apparatuses are still large in size, and have failed to be convenient. In view of this, there is a demand for smaller and lighter supply systems.

Meanwhile, recent electronic apparatuses, including information and communication apparatuses, are expected to cope with higher frequencies for various reasons. At higher frequencies, however, conventional components cannot be always driven as they are, and there is a need to develop components that can be driven at higher frequencies.

The supply systems necessary for higher-frequency operations include power components such as power semiconductors, inverters, converters, and reactors. It is difficult for existing magnetic materials to cope with higher frequencies. If power components that are driven at higher frequencies than those currently used are developed, not only can high-frequency supply systems be realized, but also the supply systems become smaller and lighter, because component sizes become smaller at higher frequencies. In view of this, there is a strong demand for a novel magnetic material that can be driven at higher frequencies and has high magnetic flux density, high magnetic permeability, and low loss, so as to realize smaller supply systems.

Existing metal materials such as magnetic steel sheets have high magnetic flux density, but have low electrical resistivity and high loss. Therefore, it is difficult to use such metal materials at high frequencies. Meanwhile, ferrites, which are oxides, have high electrical resistivity and low loss at high frequencies, but have lower magnetic flux density than those of metals. In response to a demand for high-frequency properties and magnetic flux density properties, powder magnetic cores formed by mixing an electrically insulating material and a resin with magnetic particles of a metal such as iron, and compressing and molding the mixture have been developed to compensate for characteristics that cannot be satisfied by a magnetic steel sheet or a ferrite alone.

However, the AC magnetic properties of conventional powder magnetic cores greatly depend on the resin that functions as the electrical insulator. To secure sufficient electrical insulation properties, a large amount of resin needs to be added, which hinders an increase in density in molded products. In other words, if magnetic metal particles are introduced at high density, it becomes difficult to maintain the insulation properties between the particles. As a result, electrical resistivity becomes lower, and loss becomes higher.

To restrain a decrease in electrical resistivity, insulating particles such as oxide particles are provided among magnetic metal particles. However, to achieve higher magnetic permeability, it is essential that magnetic metal particles are magnetically coupled (or interacted) to one another. For example, even where magnetic insulating particles such as ferrite particles are used, magnetic coupling is weak, and therefore, it is difficult to manufacture a material with high magnetic permeability.

The following is a description of embodiments, with reference to the accompanying drawings. Throughout the drawings, the same or like components are denoted by the same or like reference numerals.

(First Embodiment)

A magnetic material of this embodiment includes: first magnetic particles (hereinafter also referred to as magnetic micron particles) that contain at least one magnetic metal selected from the group including Fe, Co, and Ni, are 1 μm or greater in particle size, and are 5 to 50 μm in average particle size; second magnetic particles (hereinafter also referred to as magnetic nanoparticles) that contain at least one magnetic metal selected from the group including Fe, Co, and Ni, are smaller than 1 μm in particle size, and are 5 to 50 nm in average particle size; and intermediate phases that exist between the first magnetic particles and the second magnetic particles.

The magnetic material of this embodiment includes large magnetic metal particles having an optimum particle size for increasing magnetic permeability, and intermediate phases for securing insulating properties between the large magnetic metal particles and restraining magnetic loss. Further, to improve magnetic bonding between the large magnetic metal particles, small magnetic metal particles having a smaller particle size than the large magnetic metal particles are provided between the large magnetic metal particles. With this arrangement, this embodiment realizes a magnetic material that has high μ' and low μ' at high frequencies, and has excellent characteristics.

FIG. 1 is a schematic view of a magnetic material of this embodiment. The magnetic material includes: first magnetic particles 10 that contain at least one magnetic metal selected from the group including Fe, Co, and Ni, are 1 μm or greater in particle size, and are 5 to 50 μm in average particle size; second magnetic particles 12 that contain at least one magnetic metal selected from the group including Fe, Co, and Ni, are smaller than 1 μm in particle size, and are 5 to 50 nm in average particle size; and intermediate phases 14 that exist between the first magnetic particles 10 and the second magnetic particles 12.

Further, the intermediate phases 14 cover at least part of the second magnetic particles 12, to form composite particles 16. Here, the composite particles 16 are core-shell particles in which each of the second magnetic particles 12 has the intermediate phase 14 as a coating layer.

The average particle size of magnetic particles is determined by calculating the average of a large number of particle sizes where the particle size of each particle is the average of the longest diagonal line and the shortest diagonal line of the particle measured by TEM observation or SEM observation.

From the viewpoint of a particle size distribution of magnetic particles, the magnetic material of this embodiment includes magnetic particles containing at least one magnetic metal selected from the group including Fe, Co, and Ni, and intermediate phases existing between the magnetic particles. The particle sizes of the magnetic particles show a bimodal particle size distribution. The particle size corresponding to the first peak of the particle size distribution is not smaller than 5 μm and not larger than 50 μm, and the particle size corresponding to the second peak of the particle size distribution is not smaller than 5 nm and not larger than 50 nm.

Here, a bimodal particle size distribution is a particle size distribution having at least two peaks in a particle size distribution histogram. The particle size of each magnetic particle is the average of the longest diagonal line and the shortest diagonal line of the magnetic particle measured by TEM observation or SEM observation. So as to appropriately determine the particle size distribution of the magnetic particles in the magnetic material, the particle sizes of a sufficiently large number of magnetic particles are measured.

In this embodiment, in a case where the first magnetic particles 10 are the particles having the particle sizes in the distribution corresponding to the first peak of the bimodal particle size distribution, and the second magnetic particles 12 are the particles having the particle sizes in the distribution corresponding to the second peak of the bimodal particle size distribution, the intermediate phases 14 coat at least the second magnetic particles 12, to form the composite particles 16. When a magnetic particle cannot be clearly determined whether to belong to the distribution corresponding to the first peak or whether to belong to the distribution corresponding to the second peak, the determination should be made based on appropriate particle sizes between the first peak and the second peak. For example, magnetic particles having particle sizes equal to or greater than 1 μm are determined to be the first magnetic particles, and magnetic particles having particle sizes smaller than 1 μm are determined to be the second magnetic particles.

The magnetic metal contained in the first magnetic particles 10 and the second magnetic particles 12 contain at least one of Fe, Co, and Ni, and particularly, a Fe-base alloy, a Co-base alloy, or a FeCo-base alloy that can realize high saturation magnetization is preferable.

Examples of the Fe-base alloy and the Co-base alloy include a FeNi alloy, a FeMn alloy, a FeCu alloy, a FeMo alloy, a FeCr alloy, a CoNi alloy, a CoMn alloy, a CoCu alloy, a CoMo alloy, and a CoCr alloy, which contain Ni, Mn, Cu, Mo, Cr, or the like as the second constituent. Examples of the FeCo-base alloy include alloys containing Ni, Mn, Cu, Mo, or Cr as the second constituent. Those second constituents are effective for increasing magnetic permeability.

The second magnetic particles 12 preferably contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements. More preferably, the second magnetic particles 12 contain at least one nonmagnetic metal selected from Mg, Al, Si, Ca, Zr, Ti, Hf, rare-earth elements, Ba, and Sr. Those nonmagnetic metals are elements that have a small standard Gibbs energy of oxide formation and are easily oxidized. Therefore, those nonmagnetic metals are preferred elements, in terms of stability in the insulation properties of the intermediate phases 14 coating the second magnetic particles, such as coating oxide layers. In this case, the coating oxide layers are made of an oxide or a composite oxide containing at least one nonmagnetic metal that is a constituent of the second magnetic particles 12.

Of those nonmagnetic metals, Al and Si are particularly preferable in terms of thermal stability, as Al and Si have a high solid solubility in Fe, Co, and Ni, which are primary constituents of the second magnetic particles 10. The first magnetic particles 10 may also contain such nonmagnetic metals.

The first magnetic particles 10 and the second magnetic particles 12 preferably contain at least one of carbon and nitrogen. The first magnetic particles 10 and the second magnetic particles 12 may contain carbon alone, or nitrogen alone, or both carbon and nitrogen.

Carbon and nitrogen are useful elements that can increase magnetic anisotropy as a solid solution in a magnetic metal. A material having high magnetic anisotropy can increase ferromagnetic resonance frequency, and can be used in a high-frequency band. Additionally, μ' of a magnetic material greatly decreases near the ferromagnetic resonance frequency, and μ" greatly increases near the ferromagnetic resonance frequency.

The content of each nonmagnetic metal, carbon, or nitrogen in the first magnetic particles 10 and the second magnetic particles 12 is preferably 20 atomic % or less with respect to the magnetic metal. If the content becomes larger than that, the saturation magnetization of the magnetic particles becomes lower.

The magnetic metal contained in the magnetic particles and at least one of the nonmagnetic metals, carbon, and nitrogen are preferably in a solid solution state. In a solid solution state, magnetic anisotropy can be effectively increased, and high-frequency magnetic properties can be improved. Additionally, the mechanical properties of the magnetic material can be improved. If there is no solid solution, segregation occurs in the grain boundaries and surfaces of the magnetic particles, and magnetic anisotropy and mechanical properties cannot be effectively improved.

The first magnetic particles 10 and the second magnetic particles 12 may be either polycrystalline particles or monocrystalline particles, but are preferably monocrystalline particles. With monocrystalline particles, the easy axes of magnetization can be aligned with one another when the particles are integrated. Accordingly, magnetic anisotropy can be controlled, and better high-frequency properties than those in the case of polycrystalline particles can be achieved.

The first magnetic particles 10 and the second magnetic particles 12 may have the same compositions. Additionally, it is preferable that the compositions of the respective magnetic particles are substantially the same among the magnetic particles so as to stabilize the characteristics of the magnetic material.

The first magnetic particles 10 are 1 μm or greater in particle size, and 5 to 50 μm in average particle size. More preferably, the average particle size is 10 to 30 μm. If the particle size is smaller than 1 μm, the domain-wall pinning sites and the inversion nucleation rate per unit particle volume increase in the process of magnetization, and coercivity becomes higher. As a result, hysteresis loss becomes undesirably higher. Additionally, magnetic permeability becomes undesirably lower. Therefore, the particle size of the first magnetic particles 10 needs to be 1 μm or greater. As the particle size becomes larger, the above described adverse influence can be more effectively avoided. However, as the particle size becomes larger, eddy current loss becomes higher in high-frequency regions, and magnetic properties in target high-frequency regions are degraded. That is, the particle size of the first magnetic particles 10 needs to be 1 μm or greater, but a larger particle size is not necessarily preferable. Therefore, the particle size of the first magnetic particles 10 needs to fall within such a range that balance can be maintained among high magnetic permeability, low hysteresis loss, and low eddy current loss. For this reason, the average particle size of the first magnetic particles 10 is preferably in the range of 5 to 50 or more preferably, in the range of 10 to 30 μm.

The ratio of the volume of the first magnetic particles 10 to the magnetic material is preferably 30 to 80 volume percent. If the ratio is lower than 30 volume percent, magnetic permeability becomes lower. Realistically, it is difficult to achieve a higher volume ratio than 80 volume percent.

The second magnetic particles 12 are smaller than 1 μm in particle size, and 5 to 50 nm in average particle size. More preferably, the average particle size is 10 to 30 nm. As the second magnetic particles 12 exist between the first magnetic particles 10, the magnetic properties of the first magnetic particles 10 can be improved. That is, as the proportion of the total volume of the magnetic particles contained in the magnetic material can be increased by the existence of the second magnetic particles 12 having a smaller particle size than that of the first magnetic particles 10, the saturation magnetization of the magnetic material is advantageously increased. Additionally, as the second magnetic particles 12 exist between the first magnetic particles 10, the magnetic coupling between the first magnetic particles 10 becomes stronger, and as a result, magnetic permeability can be made higher. Therefore, the second magnetic particles 12 need to be smaller than the first magnetic particles 10, and need to have a smaller particle size than 1 μm. Additionally, if the eddy current loss of the second magnetic particles 12 is high, the eddy current loss of the entire magnetic material becomes undesirably high. On the other hand, the second magnetic particles 12 exist between the first magnetic particles 10 and can increase the magnetic coupling between the first magnetic particles 10 as described above. As a result, the second magnetic particles 12 behave as particles having a magnetically large particle size. Even if the particle size of the second magnetic particles 12 is small, the hysteresis loss of the magnetic material does not increase. Therefore, the second magnetic particles 12 need to have a smaller particle size than 1 μm, and for the particle size of the second magnetic particles 12, smaller is better. However, if the particle size is smaller than 5 nm, superparamagnetism occurs, and the flux content becomes undesirably insufficient.

If the particle size becomes larger than 50 nm, on the other hand, a multi-domain structure exhibits higher energy stability than a single-domain structure. The high-frequency magnetic properties of a multi-domain structure are poorer than the high-frequency magnetic properties of a single-domain structure. Therefore, the second magnetic particles 12 preferably exist as particles having a single-domain structure. The limit particle size to maintain a single-domain structure is approximately 50 nm or smaller. Therefore, the particle size is 50 nm or smaller, or more preferably, 30 nm or smaller.

In view of the above, the second magnetic particles 12 is smaller than 1 μm in particle size, and 5 to 50 nm in average particle size, or more preferably, 10 to 30 nm in average particle size.

Meanwhile, the volume ratio of the second magnetic particles 12 to the first magnetic particles 10 is preferably 3 to 30 volume percent, or more preferably, 4 to 30 volume percent. Where the volume ratio of the second magnetic particles 12 is within such a range, the second magnetic particles 12 can exist efficiently between the first magnetic particles 10, and accordingly, can improve the magnetic properties of the first magnetic particles 10. That is, as the proportion of the total volume of the magnetic particles contained in the magnetic material can be increased by the existence of the second magnetic particles 12 between the first magnetic particles 10, the saturation magnetization of the magnetic material is increased in a desirable manner. Additionally, as the existence of the second magnetic particles 12 between the first magnetic particles 10 increases the magnetic coupling between the first magnetic particles 10. As a result, magnetic permeability can be increased. The above described particle size range is such a range that saturation magnetization and magnetic permeability can be effectively increased.

The first magnetic particles 10 and the second magnetic particles 12 may be spherical particles, but may also be flat particles or rod-like particles having a high aspect ratio. Particularly, the first magnetic particles 10 are preferably flat particles or rod-like particles having a high aspect ratio.

With a high aspect ratio, shape magnetic anisotropy can be provided. As a result, not only are the high-frequency properties of the magnetic permeability improved, but also the particles can be easily integrally oriented in accordance with a magnetic field in manufacturing the magnetic field. Through the orientation, the high-frequency properties of the magnetic permeability are further improved.

Additionally, a higher aspect ratio can increase the limit particle size of a single-domain structure, and accordingly, degradation of the high-frequency properties of the magnetic permeability can be restrained even if the particles are large.

In general, particles with a large particle size are easily synthesized, a higher aspect ratio is more advantageous in terms of manufacturing.

Furthermore, with a higher aspect ratio, the filling rate of the magnetic particles can be made higher when the magnetic material is manufactured by integrating the particles.

Accordingly, the saturation magnetization per component volume and weight can be increased in a desirable manner. With that, magnetic permeability can also be increased.

In view of the above, a higher average aspect ratio is more preferable. The average aspect ratio is preferably 5 or higher, or more preferably, 10 or higher.

Figure 2:
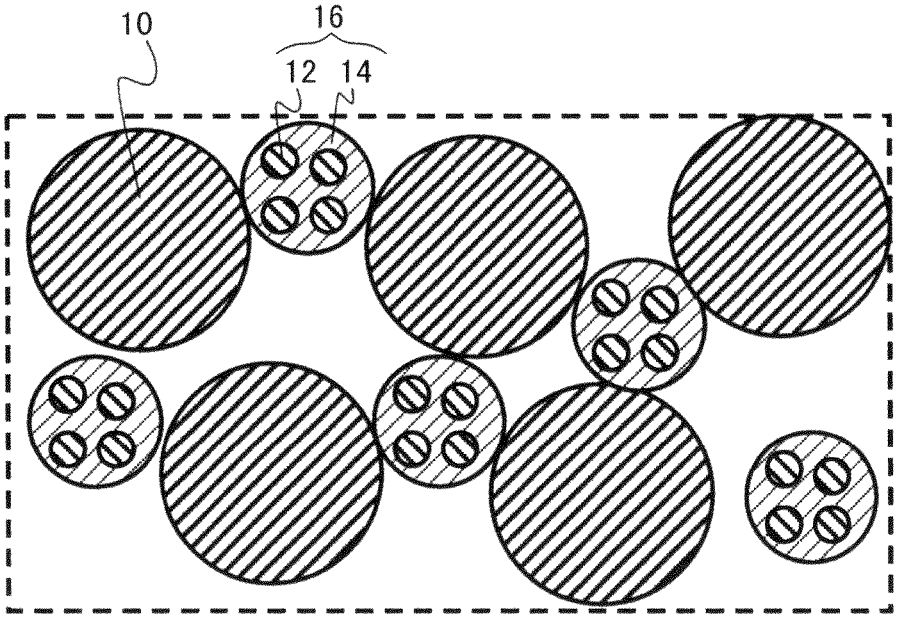
FIG. 2 is a schematic view of a modification of the magnetic material according to the first embodiment.

FIG. 2 is a schematic view of a modification of the magnetic material of this embodiment.

The material and form of the intermediate phases 14 of this embodiment are not particularly limited. In this embodiment, each of the second magnetic particles 12 is a core-shell magnetic particle having an intermediate phase 14 as the coating layer. However, as shown in FIG. 2, each of the second magnetic particles 12 may be dispersed in an insulating matrix (the intermediate phase 14) made of an oxide, a nitride, or a resin, or may form a so-called nanogranular composite particle 16. Each of the nanogranular composite particles 16 is a particulate aggregate.

Additionally, in the case of the core-shell particles shown in FIG. 1, each of the core-shell particles may be either a single particle or a particulate aggregate. Alternatively, those core-shell particles may be integrated.

The shapes of the composite particles 16 are not particularly limited either. The composite particles 16 might be flattened in the manufacturing process using sputtering or a mechanical alloy or the like, but are not limited to flat shapes.

The volume ratio of the second magnetic particles 12 to the composite particles 16 is preferably 30 to 80 volume percent, or more preferably, 40 to 80 volume percent. In such a range, the distance between each two adjacent second magnetic particles 12 contained in the composite particles 16 is inevitably short, and the magnetic metal particles are tightly coupled to each other in magnetic terms. The magnetic metal particles magnetically behave as a particulate aggregate, and magnetic permeability can be made considerably high. Since the particles are not completely bound to each other in physical terms, micro eddy current loss can be reduced, and the high-frequency properties of magnetic permeability can be improved. The above described volume ratio range is such a range that micro eddy current loss can be restrained, and magnetic permeability can be increased.

The volume ratio of the composite particles 16 to the first magnetic particles 10 is preferably 10 to 30 volume percent. Where the proportion of the volume of the composite particles 16 is within such a range, the composite particles 16 can exist efficiently between the first magnetic particles 10. Accordingly, the magnetic properties of the first magnetic particles 10 can be improved. That is, since the proportion of the total volume of the magnetic particles contained in the magnetic material can be increased by the existence of the composite particles 16 between the first magnetic particles 10, the saturation magnetization of the magnetic material is increased in a desirable manner. Additionally, as the second magnetic particles 12 exist between the first magnetic particles 10, the magnetic coupling between the first magnetic particles 10 is made stronger, and as a result, magnetic permeability can be increased. The above described volume ratio range is such a range that saturation magnetization and magnetic permeability can be effectively increased.

The atomic ratio of nonmagnetic metal to magnetic metal (nonmagnetic metal/magnetic metal) in the intermediate phases 14 in the composite particles 16 is preferably higher than the atomic ratio of nonmagnetic metal to magnetic metal (nonmagnetic metal/magnetic metal) in the second magnetic particles 12. This is because the second magnetic particles 12 can be blocked by the "intermediate phases 14 with a high ratio of nonmagnetic metal to magnetic metal (nonmagnetic metal/magnetic metal)", which have high oxidation resistance and high thermal stability, and accordingly, the oxidation resistance and the thermal stability of the second magnetic particles 12 can be effective increased.

Additionally, the content of oxygen in the intermediate phases 14 in the composite particles 16 is preferably larger than the content of oxygen in the second magnetic particles 12. This is because the second magnetic particles can be blocked by the intermediate phases 14 with high oxygen concentration, high oxidation resistance, and high thermal stability, and the oxidation resistance and the thermal stability of the second magnetic particles 12 can be effectively increased.

The composite particles 16 may not be formed, and the spaces between the first magnetic particles 10 and the second magnetic particles 12 may be filled with a resin, an oxide, or the like. Alternatively, a compound material containing resin and core-shell particles may be used. More preferably, the entire intermediate phases 14 are made of an inorganic material, so as to increase heat resistance and oxidation resistance.

In cases where the composite particles 16 are formed by the intermediate phases 14 coating the second magnetic particles 12 as shown in FIGS. 1 and 2, the intermediate phases 14 are not particularly limited, as long as the intermediate phases 14 coat part of the surfaces of the second magnetic metal particles.

The intermediate phases 14 contain at least one magnetic metal selected from Fe, Co, and Ni, and more preferably contain at least one magnetic metal that is a constituent of the second magnetic particles 12. With this arrangement, the adhesion between the second magnetic particles 12 and the intermediate phases 14 becomes higher, and thermal stability and oxidation resistance also increase.

The intermediate phases 14 preferably contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements. More preferably, the intermediate phases 14 contain at least one nonmagnetic metal selected from Mg, Al, Si, Ca, Zr, Ti, Hf, rare-earth elements, Ba, and Sr. Those nonmagnetic metals are preferable, being capable of increasing the resistance of the second magnetic particles 12, and increasing thermal stability and oxidation resistance.

The intermediate phases 14 are preferably made of a metal, a semiconductor, an oxide, a nitride, a carbide, or fluoride which contains the above described nonmagnetic metals. More preferably, the intermediate phases 14 are made of an oxide, a nitride, or a carbide, as those materials can achieve high thermal stability and high oxidation resistance.

To reduce loss due to eddy current or the like, the intermediate phases 14 have higher resistance than that of the first magnetic particles 10 and that of the second magnetic particles 12.

Ina case where the second magnetic particles 12 contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements, the intermediate phases 14 preferably contain at least one of those nonmagnetic metals. With this arrangement, the adhesion between the second magnetic particles 12 and the intermediate phases 14 can be increased, and the thermal stability and the oxidation resistance of the magnetic material can be increased.

For example, if the intermediate phases 14 are coating oxide layers, the second magnetic particles 12 contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements, and the intermediate phases 14 are preferably made of an oxide containing at least one magnetic metal and at least one of the above nonmagnetic metals.

Such coating oxide layers not only increase the oxidation resistance of the inner magnetic metals, but also electrically separate the first magnetic particles 10 from one another to increase the electrical resistivity of the magnetic material when the magnetic material is manufactured, as the coating oxide layers are interposed between the first magnetic particles 10. By increasing the electrical resistivity of the magnetic material, eddy current loss at high frequencies is restrained, and the high-frequency properties of magnetic permeability can be improved. Therefore, the coating oxide layers need to have high electrical resistivity, which is preferably 1 mΩ·cm or higher.

Metals such as Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements, at least one of which is to be selected, are preferable elements that have a small standard Gibbs energy of oxide formation and easily form stable oxides. Particularly, Mg, Al, Si, Ca, Zr, Ti, Hf, rare-earth elements, Ba, and Sr are preferable, having a small standard Gibbs energy of oxide formation. Elements that have a large standard Gibbs energy of formation are not easily oxidized, and therefore, are not preferable.

The coating oxide layers are made of an oxide or a composite oxide containing at least one nonmagnetic metal that is one of the constituents of the second magnetic particles 12. Accordingly, the adhesion and bonding properties between the magnetic particles and the coating oxide layers are improved, and a thermally stable material is obtained.

At this point, Al and Si have high solid solubility for Fe, Co, and Ni, which are the primary constituents of magnetic particles. Therefore, Al and Si are preferable, in terms of thermal stability of magnetic metal particles. That is, the coating oxide layers are preferably made of an oxide containing Al or Si. The coating oxide layers may be made of one oxide or a composite oxide containing oxides including a solid solution.

The thickness of each coating oxide layers is 0.1 to 100 nm. If the thickness is smaller than 0.1 nm, oxidation resistance becomes insufficient, and eddy current loss easily occurs due to low resistance of the component when particles are integrated to form the magnetic material. As a result, the high-frequency properties of magnetic permeability are degraded, which is undesirable.

If the thickness is greater than 100 nm, the filling rate of the magnetic metal particles contained in the magnetic material becomes lower when particles are integrated to form the magnetic material. As a result, the saturation magnetization of the magnetic material becomes lower, and magnetic permeability also becomes undesirably lower. Each of the coating oxide layers should have a thickness of 0.1 to 100 nm so that degradation of high-frequency properties is prevented by restraining eddy current loss, and a decrease in magnetic permeability is avoided by preventing a large decrease in saturation magnetization.

Next, an example of a method of manufacturing the magnetic material according to this embodiment is described.

The method of manufacturing the magnetic material according to this embodiment includes: synthesizing first magnetic particles that contain at least one magnetic metal selected from the group including Fe, Co, and Ni, and are 5 to 50 μm in average particle size; synthesizing second magnetic particles that contain at least one magnetic metal selected from the group including Fe, Co, and Ni, and are 5 to 50 nm in average particle size; synthesizing intermediate phases; and mixing and molding the first magnetic particles, the second magnetic particles, and the intermediate phases.

The steps of synthesizing the first magnetic particles, the second magnetic particles, and the intermediate phases may be carried out independently of one another, or two or more of those steps may be simultaneously carried out. As for the mixing step, any two sets of the first magnetic particles, the second magnetic particles, and the intermediate phases may be mixed independently of each other, and the remaining set may be mixed with the others. Alternatively, the three sets may be mixed at the same time.

For examples, composite particles are formed with the second magnetic particles and the intermediate phases, and the composite particles and the first magnetic particles are then mixed and molded.

For example, the second magnetic particles contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements, and the intermediate phases contain at least one of those nonmagnetic metals. The composite particles form core-shell particles in which at least part of each of the second magnetic particles is coated with the intermediate phases. Specifically, nanoparticles formed by thermal plasma are turned into core-shell magnetic particles by processing, and are combined with a mechanical alloy. In this manner, the composite particles can be formed.

Alternatively, the second magnetic particles contain at least one nonmagnetic metal selected from Mg, Al, Si, Ca, Zr, Ti, Hf, Zn, Mn, Ba, Sr, Cr, Mo, Ag, Ga, Sc, V, Y, Nb, Pb, Cu, In, Sn, and rare-earth elements, and the intermediate phases contain at least one of those nonmagnetic metals, for example. The composite particles form nanogranular particles in which two or more second magnetic particles are coated with one intermediate phase.

The step of synthesizing the intermediate phases is not particularly limited. For example, an oxide and a magnetic metal are simultaneously sputtered, to form a composite thin film (or a nanogranular thin film) of the magnetic metal and the oxide. The thin film is pulverized, to synthesize composite particles of the second magnetic particles and an insulating film. Additionally, when the core-shell magnetic particles are manufactured, fine oxide particles can be further added.

The step of mixing the first magnetic particles, the second magnetic particles, and the intermediate phases is not particularly limited. Mixing in a mortar or mixing in a ball mill can be performed. Additionally, by adding a binder with high viscosity such as a resin, mixing can be performed with a kneading machine such as a triple roll mill.

It is widely known that effective mixing can be performed by adding a binder. Further, by adding a binder, magnetic particles are bonded to one another, to form a firm magnetic material. The binder is preferably an insulating material, because an insulating material not only bond magnetic particles to one another but also can function as an intermediate phase between the magnetic particles and improve the insulating properties between the magnetic particles. An organic binder such as a resin or an inorganic binder such as glass can be used, but the binder to be used here is not limited to them.

In a case where a resin is used as the binder, the resin is not particularly limited. Specific examples of such resins include polyester resins, polyethylene resins, polystyrene resins, polyvinyl chloride resins, polyvinyl butyral resins, polyurethane resins, cellulose resins, ABS resins, nitrile-butadiene rubbers, styrene-butadiene rubbers, silicon rubbers, other synthetic rubbers, natural rubbers, epoxy resins, phenol resins, amide resins, imide resins, and copolymers of those materials.

The inorganic binder to be used in this embodiment is not particularly limited. Specifically, a glass phase of a low-melting-point oxide such as $B_2O_3$, NaO, $SiO_2$, ZnO, or PbO can be used.

Alternatively, an eutectic generation system can be used and integrated. Possible examples of eutectic generation systems include $B_2O_3$—$SiO_2$, $B_2O_3$—$Cr_2O_3$, $B_2O_3$—$MoO_3$, $B_2O_3$—$Nb_2O_5$, $B_2O_3$—$Li_2O_3$, $B_2O_3$—BaO, $B_2O_3$—ZnO, $B_2O_3$—$La_2O_3$, and $Na_2O$—$SiO_2$.

Such combinations of oxides have low eutectic points and relatively readily generate eutectics. Therefore, such combinations are preferable. Particularly, those having eutectic points at 1000° C. or lower are preferable. An eutectic structure formed with such a combination of oxides is a microstructure with high strength, and is preferable accordingly.

In a combination of a first oxide and a second oxide, the melting point of the first oxide is at least 200° C. higher than that of the second oxide, or more preferably, is at least 500° C. higher than that of the second oxide. The first oxide is coated with at least part of the surfaces of the magnetic particles, and serves as the final measure to restrain agglomeration of magnetic particles. Having a higher melting point than that of the second oxide, the first oxide restrains agglomeration of magnetic particles at high temperatures, and can increase thermal stability.

To form eutectics, an additive to form eutectics with the inorganic phases that are the intermediate phases in the composite particles can be added as the binder. For example, $B_2O_3$ is added to the composite particles formed with $SiO_2$ phases and Fe-based second magnetic particles, and a heat treatment is performed. In this manner, the composite particles and the first magnetic particles can be bonded and integrated.

The magnetic material of this embodiment may contain the following inorganic materials. For example, $Al_2O_3$ may be dispersed in an epoxy resin. The magnetic material may contain an inorganic material such as an oxide, a nitride, or a carbide. Specific examples of such inorganic materials include $Al_2O_3$, AlN, $SiO_2$, and SiC.

The magnetic material of this embodiment characteristically has a small imaginary part and a small real part of complex permittivity in a required frequency band. Therefore, the imaginary part and the real part of the complex permittivity of the contained inorganic material are preferably small. Such an inorganic material may be added at the time of mixing, or may be added at the time of molding. Alternatively, a raw material containing such an inorganic material as an impurity or a byproduct generated in the core-shell forming step may be used.

In the method of manufacturing the magnetic material of this embodiment, the step of mixing and molding the first magnetic particles, the second magnetic particles, and the intermediate phases is not particularly limited. A slurry having a binder added thereto as described above may be formed, and sheet molding is performed. The resultant product may be clamped and laminated. Alternatively, a compound material containing a binder such as a resin may be formed in advance, and a metal mold or the like is then filled with the compound material, followed by compression.

By the above described manufacturing method, a magnetic material having high μ' and low μ" at high frequencies, and exhibits excellent characteristics can be manufactured.

(Second Embodiment)

A method of manufacturing a magnetic material according to this embodiment includes: molding a slurry containing anisotropic magnetic particles and a binder; forming a solidified material having the anisotropic magnetic particles oriented therein; forming magnetic parts by finely dividing the solidified material; and molding the magnetic parts in a magnetic field.

The compositions and forms of preferred magnetic particles, and preferred binders are the same as those of the first embodiment, and therefore, explanation of them is omitted herein.

According to this embodiment, the anisotropic magnetic particles are oriented through two stages, so as to improve the magnetic anisotropy and magnetic permeability of the magnetic material. Accordingly, a magnetic material having high μ' and low μ", and exhibits excellent characteristics can be manufactured.

First, a slurry containing anisotropic magnetic particles and a binder is molded. A solidified material having the anisotropic magnetic particles oriented therein is formed.

For example, anisotropic magnetic parts are obtained by molding, in a magnetic field, an anisotropic magnetic particle slurry having anisotropic magnetic particles dispersed in a liquid. However, it is difficult to achieve both dispersion and high density. If there is high concentration, coagulative precipitation occurs. Therefore, orientation is not easily caused by a magnetic field, and unevenness appears. As a result, it is difficult to obtain uniform molded products. For example, a solidified material obtained after providing anisotropy has unevenness caused by voids, and as a result, the density of magnetic particles becomes lower.

In this embodiment, magnetic parts are formed by finely dividing a solidified material having magnetic particles oriented therein by pulverization or the like. The magnetic parts are collected and molding is again performed in a magnetic field. In this manner, an anisotropic magnetic material having high density, high strength, and high orientation can be obtained.

In the molding in a magnetic field, a nonmagnetic material is used as the metal mold. However, the strength is poor, and there is a limit to the pressure that can be applied. Therefore, a high-strength magnetic material (a molded product) might not be obtained.

In such a case, a provisional magnetic material (a provisional molded product) molded in a magnetic field is taken out, and is again introduced into a metal mold with higher strength. After that, a higher voltage is applied, to form a magnetic material with higher density while the provisional molding orientation is maintained.

In the step of forming the solidified material, a slurry is preferably molded in a magnetic field. However, the molding method is not limited, as long as a solidified material having anisotropic magnetic particles oriented therein can be formed. For example, in the molding, orientation may be caused while a shear stress is applied by a doctor blade method. If molding is performed in a magnetic field while a shear stress is applied by a doctor blade method, the orientation of anisotropic magnetic particles becomes higher, which is preferable.

(Third Embodiment)

An inductor element according to this embodiment is an inductor element including the magnetic material of the first or second embodiment.

Figure 3:
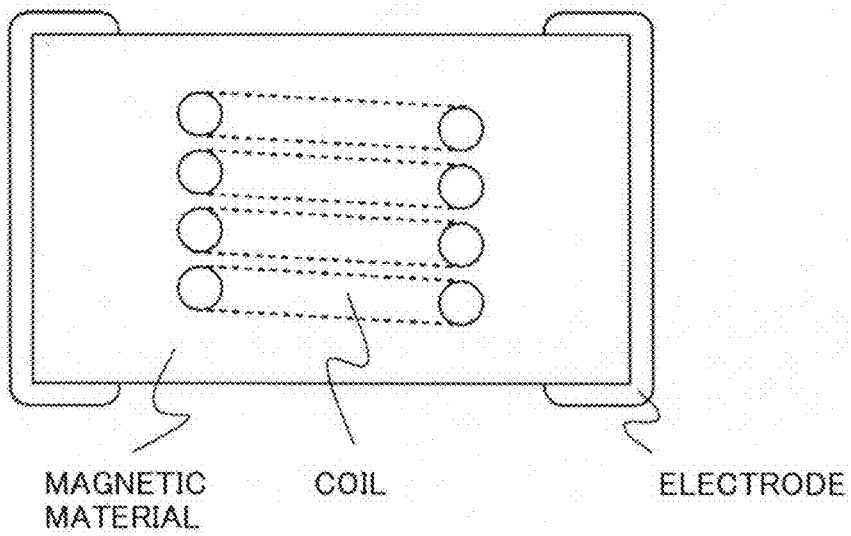
FIG. 3 is a conceptual diagram showing an example of an inductor element according to a third embodiment.

FIG. 3 is a conceptual diagram showing an example of the inductor element of this embodiment. This diagram shows the cross-section of a chip inductor element. Ends of the coil (not shown) are each connected to electrodes.

Figure 4:
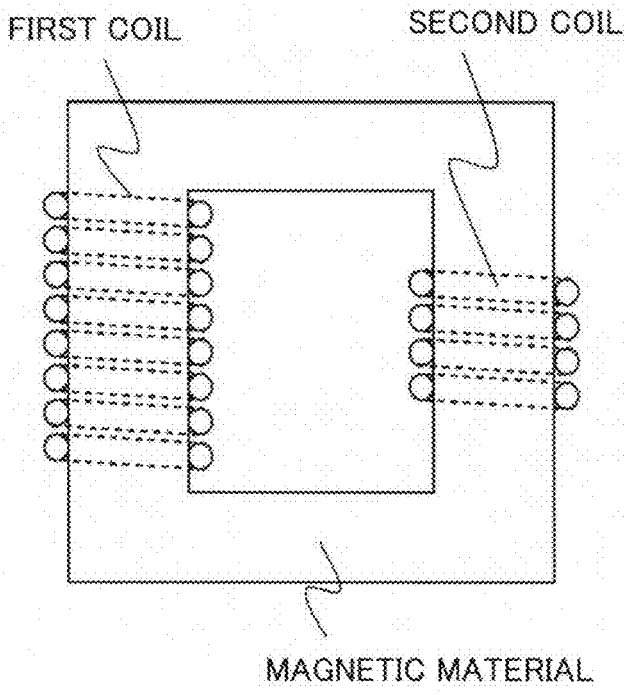
FIG. 4 is a conceptual diagram showing another example of the inductor element according to the third embodiment.

FIG. 4 is a conceptual diagram showing another example of the inductor element of this embodiment. This diagram shows the cross-section of a transformer. Two electrode terminals (not shown) are provided in a first coil, and two electrode terminals (not shown) are provided in a second coil.

Figure 5:
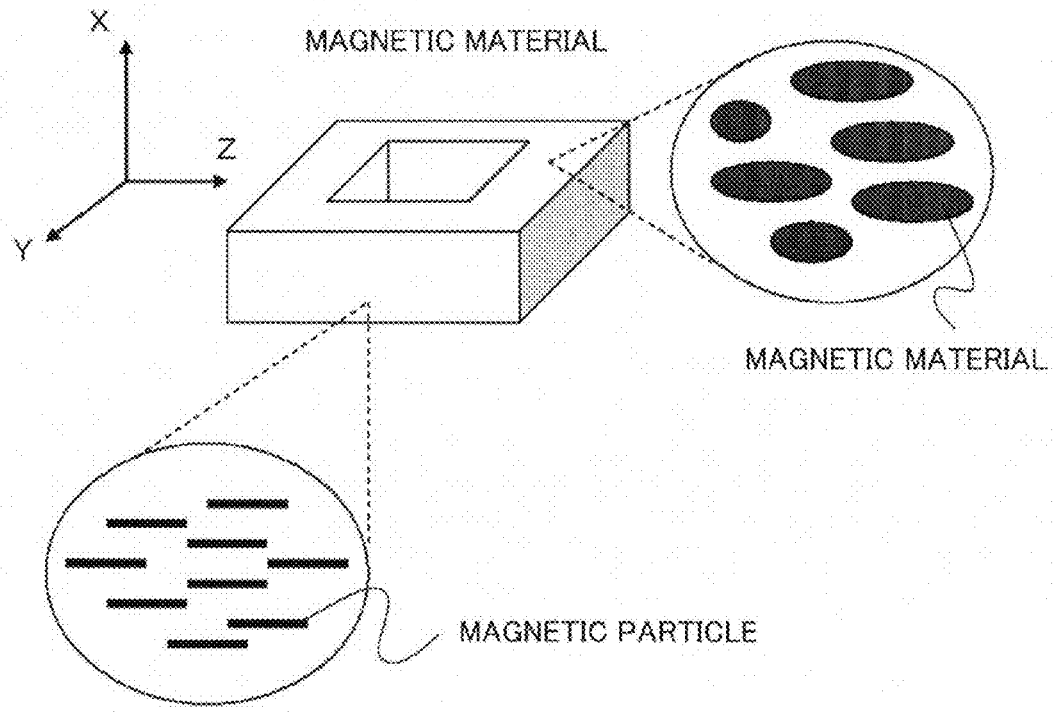
FIG. 5 is a diagram showing the alignment positional relationship between the magnetic core of the inductor element of the third embodiment and flat magnetic particles.

FIG. 5 is a diagram showing the alignment positional relationship between the magnetic core of the inductor element of this embodiment and flat magnetic particles. When the flat surface normal of the flat magnetic particles matches the direction of the Z-axis in the drawing, the magnetic flux density in the coil becomes highest, and accordingly, the inductor element performance is improved.

This embodiment can realize an inductor element that has a high real part of magnetic permeability (μ') and a low imaginary part of magnetic permeability (μ") in a MHz band, particularly, in a MHz band of 100 kHz or higher, and has high strength, high saturation magnetization, high thermal stability, and high oxidation resistance.

While certain embodiments have been described, these embodiments have been presented by way of example only, and are not intended to limit the scope of the inventions. Indeed, magnetic materials, methods of manufacturing magnetic material, and inductor element using magnetic material described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

In the magnetic materials and inductor element according to the above embodiments, material organizations can be observed (analyzed) by SEM (Scanning Electron Microscopy) or TEM (Transmission Electron Microscopy), diffraction patterns (including solid solubility checks) can be observed (analyzed) by TEM-Diffraction or XRD (X-ray Diffraction), and constituent element identification and quantitative analysis can be performed by ICP (Inductively Coupled Plasma) emission analysis, fluorescent X-ray analysis, EPMA (Electron Probe Micro-Analysis), EDX (Energy Dispersive X-ray Fluorescence Spectrometer), or the like.

The average particle size of magnetic particles is determined by calculating the average of a large number of particle sizes where the particle size of each particle is the average of the longest diagonal line and the shortest diagonal line of the particle measured by TEM observation or SEM observation.

Here, an "aspect ratio" is the ratio between the size of a particle in the direction in which the length of the particle becomes longest (the long dimension) and the size of the particle in the direction in which the length of the particle becomes shortest (the short dimension), the directions being perpendicular to each other. That is, an "aspect ratio" is the ratio of the short dimension to the long dimension. Therefore, an aspect ratio is always 1 or higher. In the case of a completely spherical shape, the aspect ratio is 1, because the long dimension and the short dimension are both equal to the diameter of the sphere. The aspect ratio of a flat particle is the ratio of the height (the short dimension) to the diameter (the long dimension). The aspect ratio of a rod-like shape is the ratio of the diameter of the bottom surface of the rod (the short dimension) to the length of the rod (the long dimension). However, the aspect ratio of a spheroid is the ratio of the short axis (the short dimension) to the long axis (the long dimension). As the aspect ratio is made higher, shape magnetic anisotropy can be provided. By aligning the easy axes of magnetization in one direction, magnetic permeability and the high-frequency properties of the magnetic permeability can be improved. The value obtained by calculating the average the aspect ratios of a large number of particles is a "average aspect ratio." Additionally, the values obtained by calculating the averages of the long dimensions and the short dimensions of a large number of particles are a "average long dimension" and a "average short dimension."

EXAMPLES

In the following, examples are described in conjunction with comparative examples. Table 1 shows the shapes, average particle sizes (or average heights), average aspect ratios, compositions, volume ratios, and the like of the magnetic particles in magnetic materials of the following examples and comparative examples. It should be noted that the average particle sizes (or average heights) of the magnetic particles were measured through TEM observation. Specifically, each average particle size was determined by calculating the average of particle sizes, where each particle size was the average of the longest diameter and the shortest diameter of a particle that was observed (or shown in photographs). Three unit areas of 10 μm×10 μm were photographed, and the average values were determined. Composition analysis of microstructures was evaluated based on EDX analysis.

In the table, volume ratio VF1 is the volume ratio of first magnetic particles to the corresponding magnetic material. VF2 represents the volume ratio of second magnetic particles to the corresponding composite particles. VF3 represents the volume ratio of composite particles to the corresponding first magnetic particles. Where the second magnetic particles are not composite particles, VF3 represents the volume ratio of the second magnetic particles to the first magnetic particles.

The volume ratios of the first magnetic particles, the second magnetic particles, and the composite particles are calculated from cross-sectional SEM images and cross-sectional TEM images of the magnetic materials. For large-sized particles, cross-sectional SEM images are mainly used. For small-sized particles, cross-sectional TEM images are mainly used. To calculate a volume ratio, the average particle size of particles is first determined by cross-sectional SEM or cross-sectional TEM. At this point, the average particle size can be determined by calculating the average of a large number, 50, for example, of particles, where each particle size is the average of the longest diagonal line and the shortest diagonal line of each corresponding particle. If the average particle size of magnetic particles is as small as 50 nm or less and is not clearly seen by TEM, a crystal grain size determined through XRD measurement can be used, instead. That is, by XRD, the largest one of the peaks formed by magnetic particles can be determined according to the Scherrer equation using diffraction angle and half-value width. The Scherrer equation is expressed as $D=0.9\lambda/(\beta \cos \theta)$, where D represents the crystal grain size, λ represents the measured X-ray wavelength, β represents the half-value width, and θ represents the Bragg diffraction angle.

The long dimension (the diameter in the case of a flat shape, the length of a rod in the case of a rod-like shape) and the short dimension (a height in the case of a flat shape, and the diameter of the bottom surface of a rod in the case of a rod-like shape) of each of the particles such as flat particles or rod-like particles having high aspect ratios can also be determined in the same manner as above. An aspect ratio is determined from the average value determined by analyzing images through TEM or SEM and analyzing a large number of magnetic particles. The volume ratios and volume filling rates of the magnetic particles can be easily determined by calculating average particle sizes, average aspect ratios, and proportions in number through TEM observation or SEM observation.

First, examples equivalent to the first embodiment are described as Examples 1-1 through 11, and are compared with Comparative Examples 1-1 through 2-2.

Example 1-1

Spherical FeCoAl magnetic micron particles (first magnetic particles) are synthesized by water atomization. Argon is then introduced as a plasma generating gas into a chamber of a high-frequency induction thermal plasma device at 40 L/min, to generate plasma. Fe particles of 10 μm in average particle size, Co particles of 10 μm in average particle size, and Al particles of 3 μm in average particle size, together with argon (a carrier gas), are sprayed as raw materials to the plasma in the chamber at 3 L/min, followed by rapid cooling. As a result, spherical FeCoAl magnetic nanoparticles (second magnetic particles) are obtained. The FeCoAl magnetic micron particles, the magnetic nanoparticles, and a binder PVB are mixed and granulated in a ball mill, to obtain composite powder. The composite powder is integrated by press molding, to form a magnetic material to be evaluated.

Example 1-2

Instead of the FeCoAl magnetic micron particles formed by water atomization in Example 1-1, FeNiSi magnetic micron particles are synthesized. After that, the same procedures as those of Example 1-1 are carried out, to form a magnetic material to be evaluated.

Example 2

FeNiSi magnetic micron particles and FeCoAl magnetic nanoparticles are synthesized in the same manner as in Example 1-2. The FeCoAl magnetic nanoparticles are then subjected to a heat treatment in 10 ppm of oxygen at 200° C., to form a FeCoAl—O coating layer on each surface and form core-shell composite particles. After that, the FeCoAl magnetic nanoparticles having the FeCoAl—O coating layers formed thereon, the FeNiSi magnetic micron particles, and a binder PVB are mixed and granulated in a ball mill, to obtain composite powder. The composite powder is integrated by press molding, to form a magnetic material to be evaluated.

Example 3-1

Spherical FeNiSi magnetic micron particles and spherical FeCoAl magnetic nanoparticles are synthesized in the same manner as in Example 2. Fine powder of $SiO_2$ is then synthesized by a coprecipitation technique. The spherical FeCoAl magnetic particles, the FeNiSi magnetic particles, and the $SiO_2$ fine powder are mixed and granulated in a ball mill, to obtain composite powder. The composite powder is integrated by press molding, to form a magnetic material to be evaluated.

Example 3-2

Composite powder is obtained in the same manner as in Example 3-1. A binder PVB is added to the composite powder, and the binder PVB and the composite powder are mixed, granulated, and integrated by press molding. In this manner, a magnetic material to be evaluated is formed.

Example 4-1

FeNiSi magnetic micron particles and FeCoAl magnetic nanoparticles are synthesized in the same manner as in Example 2. The FeCoAl magnetic nanoparticles are subjected to a compounding process at approximately 2000 rpm in an Ar atmosphere in a planetary mill using $ZrO_2$ balls and $ZrO_2$ pots. In this manner, nanogranular composite particles formed with magnetic metal particles and an oxide containing a nonmagnetic metal are synthesized. The composite particles, the FeNiSi magnetic micron particles, and a binder PVB are mixed and granulated in a ball mill, to obtain composite powder. The composite powder is integrated by press molding, to form a magnetic material to be evaluated.

Example 4-2

FeCoAl magnetic nanoparticles are synthesized in the same manner as in Example 4-1. The FeCoAl magnetic nanoparticles and the same $SiO_2$ fine powder as that of Example 3-1 are subjected to a compounding process at approximately 2000 rpm in an Ar atmosphere in a planetary mill using $ZrO_2$ balls and $ZrO_2$ containers. In this manner, nanogranular composite particles formed with magnetic metal particles and an oxide containing a nonmagnetic metal are synthesized. The composite particles, the FeNiSi magnetic micron particles, and a binder PVB are mixed and granulated in a ball mill, to obtain composite powder. The composite powder is integrated by press molding, to form a magnetic material to be evaluated.

Example 4-3

A magnetic material is manufactured in the same manner as in Example 4-1, except that the volume ratio (VF3) between the composite particles and the FeNiSi magnetic particles (the first magnetic particles) is different.

Example 5-1

FeNiSi magnetic micron particles and nanogranular FeCoAl magnetic nanoparticles having FeCoAl—O coating layers formed thereon are synthesized in the same manner as in Example 2. The FeNiSi magnetic micron particles and the core-shell FeCoAl magnetic nanoparticles having the FeCoAl—O coating layers formed thereon are subjected to a compounding process at approximately 2000 rpm in an Ar atmosphere in a planetary mill. In this manner, nanogranular composite particles formed with magnetic metal particles and an oxide containing a nonmagnetic metal are synthesized between the FeNiSi magnetic micron particles, to form composite magnetic powder. The composite magnetic powder is then integrated by press molding, to form a magnetic material to be evaluated.

Example 5-2

Composite magnetic powder is synthesized in the same manner as in Example 5-1. A binder PVB is then added to the composite magnetic powder, followed by mixing. The binder PVB and the composite magnetic powder are then integrated by press molding, to form a magnetic material to be evaluated.

Example 6-1

FeNiSi magnetic micron particles and core-shell FeCoSi magnetic nanoparticles having FeCoSi—O coating layers formed thereon are synthesized in the same manner as in Example 2. The FeCoSi magnetic nanoparticles having the FeCoSi—O coating layers formed thereon and $B_2O_3$ particles are mixed well in a ball mill. After that, a heat treatment is performed in vacuum at 600° C., to synthesize nanogranular composite particles formed with magnetic metal particles and an oxide containing a nonmagnetic metal. The composite particles and the FeNiSi magnetic micron particles are mixed in a ball mill. After press molding, a heat treatment is again performed in vacuum at 600° C., to achieve integration and form a magnetic material to be evaluated.

Example 6-2

FeNiSi magnetic micron particles and core-shell FeCoSi magnetic nanoparticles having FeCoSi—O coating layers formed thereon are synthesized in the same manner as in Example 2. The FeNiSi magnetic micron particles are then coated with $SiO_2$ by a sol-gel technique. The FeNiSi magnetic micron particles having the $SiO_2$ coating layers formed thereon and $B_2O_3$ particles are mixed well in a ball mill. After that, a heat treatment is performed in vacuum at 600° C., to synthesize a composite material formed with magnetic metal particles and an oxide containing a nonmagnetic metal. The composite material and the core-shell FeCoSi magnetic nanoparticles having the FeCoSi—O coating layers formed thereon are mixed in a ball mill. After press molding, a heat treatment is again performed in vacuum at 600° C., to achieve integration and form a magnetic material to be evaluated.

Example 7-1

A magnetic material is manufactured in the same manner as in Example 2, except that the volume ratio VF1 of the FeNiSi magnetic micron particles is different.

Example 7-2

A magnetic material is manufactured in the same manner as in Example 2, except that the volume ratio VF1 of the FeNiSi magnetic micron particles is different.

Example 7-3

A magnetic material is manufactured in the same manner as in Example 2, except that the volume ratio VF1 of the FeNiSi magnetic micron particles is different.

Example 8-1

A magnetic material is manufactured in the same manner as in Example 2, except that the composition of the first magnetic particles is different.

Example 8-2

A magnetic material is manufactured in the same manner as in Example 2, except that the shape of the first magnetic particles is different. Flat particles are manufactured in the following manner. Magnetic particles of 40 μm in average particle size are subjected to a flattening process at approximately 2000 rpm in an Ar atmosphere in a planetary mill using $ZrO_2$ balls and $ZrO_2$ pots, to obtain the flat particles shown in Table 1.

Example 8-3

A magnetic material is manufactured in the same manner as in Example 2, except that the composition and shape of the first magnetic particles are different. Flat particles are manufactured in the following manner. Magnetic particles of 40 μm in average particle size are subjected to a flattening process at approximately 2000 rpm in an Ar atmosphere in a planetary mill using $ZrO_2$ balls and $ZrO_2$ pots, to obtain the flat particles shown in Table 1.

Example 9

The FeNiSi magnetic micron particles of Example 2 are subjected to a partial oxidation process, to form a FeNiSi—O oxide on the surfaces of the FeNiSi magnetic micron particles and manufacture core-shell FeNiSi magnetic micron particles. Additionally, core-shell magnetic nanoparticles having FeCoAl—O coating layers formed thereon are synthesized. The procedures to be carried out thereafter are the same as those of Example 2.

Example 10-1

FeNiSi flat magnetic micron particles are manufactured in the same manner as in Example 8-2. The obtained flat powder is subjected to a sufficient heat treatment in a $H_2$ atmosphere, to obtain uniform flat magnetic micron particles. The obtained flat magnetic micron particles are then subjected to a partial oxidation process, to form FeNiSi—O coating oxide layers on the surfaces of the FeNiSi flat magnetic micron particles, and manufacture core-shell FeNiSi flat magnetic micron particles. The procedures to be carried out thereafter are the same as those of Example 2.

Example 10-2

FeSiCr flat magnetic micron particles are manufactured in the same manner as in Example 10-1. The obtained flat powder is then subjected to a sufficient heat treatment in a $H_2$ atmosphere, to obtain uniform flat magnetic micron particles. The obtained flat magnetic micron particles are then subjected to a partial oxidation process, to form FeSiCr—O coating oxide layers on the surfaces of the FeSiCr flat magnetic micron particles. The procedures to be carried out thereafter are the same as those of Example 2.

Example 10-3

Core-shell FeNiSi flat magnetic micron particles having FeNiSi—O coating layers formed thereon are manufactured in the same manner as in Example 10-1. Additionally, core-shell FeCoAl magnetic nanoparticles having FeCoAl—O coating layers formed thereon are subjected to a compounding process at approximately 2000 rpm in an Ar atmosphere in a planetary mill using $ZrO_2$ balls and $ZrO_2$ pots, to form the same nanogranular composite particles as those of Example 4. After that, the core-shell FeNiSi flat magnetic micron particles, the composite particles, and PVB are mixed well and are integrated by press molding, to form a magnetic material to be evaluated.

Example 10-4

Core-shell FeNiSi flat magnetic micron particles having FeNiSi—O coating layers formed thereon are manufactured in the same manner as in Example 10-2. After that, $B_2O_3$ particles, the core-shell FeNiSi flat magnetic micron particles, and core-shell FeCoAl magnetic nanoparticles having FeCoAl—O coating layers formed thereon are mixed well in a ball mill. After press molding, a heat treatment is again performed in vacuum at 600° C., to achieve integration and to form a magnetic material to be evaluated.

Example 11

In the same manner as in Example 10-3, core-shell FeNiSi flat magnetic micron particles, composite particles, and PVB are mixed well and granulated, to obtain composite powder. The composite powder is molded in a magnetic field, to obtain a single orientation and form a magnetic material to be evaluated.

Comparative Example 1-1

The spherical FeCoAl magnetic nanoparticles synthesized in Example 1-1 and a binder PVB are subjected to press molding, to form a magnetic material to be evaluated.

Comparative Example 1-2

The spherical FeCoAl magnetic micron particles synthesized in Example 1-1 and a binder PVB are mixed in a ball mill and are subjected to press molding, to form a magnetic material to be evaluated.

Comparative Example 2-1

The spherical FeCoAl magnetic nanoparticles synthesized in Example 2 are coated with FeCoAl—O coating layers by a partial oxidation process, to form core-shell magnetic nanoparticles.

The core-shell magnetic nanoparticles and a binder PVB are subjected to press molding, to form a magnetic material to be evaluated.

Comparative Example 2-2

In the same manner as in Example 9, spherical FeNiSi magnetic micron particles are coated with FeNiSi—O layers, to obtain core-shell FeNiSi magnetic micron particles. The core-shell FeNiSi magnetic micron particles and a binder PVB are subjected to press molding, to form a magnetic material to be evaluated.

Of each material of Examples 1-1 through 11 and Comparative Examples 1-1 through 2-2 to be evaluated, the real part of magnetic permeability (μ') and magnetic permeability loss (μ–tan δ=μ"/μ'×100(%)) are evaluated in the manner described below. The evaluation results are shown in Table 1.

Using an impedance analyzer, the magnetic permeability of each ring-like sample is measured. In the measurement, the real part W and the imaginary part μ" are measured at a frequency of 10 MHz. Magnetic permeability loss μ–tan δ is calculated by the formula, μ"/μ'×100(%).

TABLE 1

| | First Magnetic Particle | | | | | Second Magnetic Particle | | | | | | | Characteristics of Magnetic Material | |
|---|---|---|---|---|---|---|---|---|---|---|---|---|---|---|
| | Shape | Mean Particle Size (Spherical) Mean Height (Flat) (μm) | Mean Aspect Ratio | Composition | Volume Ratio VF1 (%) | Shape | Mean Particle Size (nm) | Mean Aspect Ratio | Composition | Volume Ratio VF2 (%) | Intervening Phase Intervening Phase Material and Form | Volume Ratio VF3 (%) | Real Part of Magnetic Permeability μ' (@10 MHz) | Magnetic Permeability Loss μ tan δ (%) (@10 MHz) |
| Example 1-1 | Spherical | 40 | ca. 1 | Fe—Co—Al | 60 | Spherical | 25 | ca. 1 | Fe—Co—Al | — | PVB | 20 | 15 | <1 |
| Example 1-2 | Spherical | 40 | ca. 1 | Fe—Ni—Si | 60 | Spherical | 25 | ca. 1 | Fe—Co—Al | — | PVB | 22 | 18 | <1 |
| Example 2 | Spherical | 40 | ca. 1 | Fe—Ni—Si | 60 | Spherical | 25 | ca. 1 | Fe—Co—Al | 70 | Fe—Co—Al—O phase as coating layer for second magnetic particles (of core-shell type) + PVB | 21 | 22 | <1 |
| Example 3-1 | Spherical | 40 | ca. 1 | Fe—Ni—Si | 60 | Spherical | 25 | ca. 1 | Fe—Co—Al | — | Si—O particles | 18 | 17 | <1 |
| Example 3-2 | Spherical | 40 | ca. 1 | Fe—Ni—Si | 60 | Spherical | 25 | ca. 1 | Fe—Co—Al | — | Si—O particles + PVB | 16 | 20 | <1 |
| Example 4-1 | Spherical | 40 | ca. 1 | Fe—Ni—Si | 60 | Spherical | 25 | ca. 1 | Fe—Co—Al | 50 | Fe—Co—Al—O phase as coating layer for second magnetic particles (of nanogranular type) + PVB | 25 | 20 | <1 |
| Example 4-2 | Spherical | 40 | ca. 1 | Fe—Ni—Si | 60 | Spherical | 25 | ca. 1 | Fe—Co—Al | 40 | Si—Fe—Co—Al—O phase as coating layer for second magnetic particles (of nanogranular type) + PVB | 25 | 18 | <1 |
| Example 4-3 | Spherical | 40 | ca. 1 | Fe—Ni—Si | 60 | Spherical | 25 | ca. 1 | Fe—Co—Al | 52 | Fe—Co—Al—O phase as coating layer for second magnetic particles (of nanogranular type) + PVB | 15 | 17 | <1 |
| Example 5-1 | Spherical | 40 | ca. 1 | Fe—Ni—Si | 60 | Spherical | 25 | ca. 1 | Fe—Co—Al | 53 | Fe—Co—Al—O phase as coating layer for second magnetic particles (of nanogranular type) | 25 | 22 | <1 |
| Example 5-2 | Spherical | 40 | ca. 1 | Fe—Ni—Si | 60 | Spherical | 25 | ca. 1 | Fe—Co—Al | 55 | Fe—Co—Al—O phase as coating layer for second magnetic particles (of nanogranular type) + PVB | 25 | 23 | <1 |
| Example 6-1 | Spherical | 40 | ca. 1 | Fe—Ni—Si | 60 | Spherical | 25 | ca. 1 | Fe—Co—Si | 50 | B—Fe—Co—Si—O phase as coating layer for second magnetic particles (of nanogranular type) | 15 | 15 | <1 |
| Example 6-2 | Spherical | 40 | ca. 1 | Fe—Ni—Si | 60 | Spherical | 25 | ca. 1 | Fe—Co—Si | — | Fe—Co—Si—B—O phase, reactant of second particle coating layer, first magnetic particle coating layer, and $B_2O_3$ particles | 11 | 16 | <1 |
| Example 7-1 | Spherical | 40 | ca. 1 | Fe—Ni—Si | 55 | Spherical | 25 | ca. 1 | Fe—Co—Al | 70 | Fe—Co—Al—O phase as coating layer for second magnetic particles (of core-shell type) + PVB | 30 | 22 | <1 |
| Example 7-2 | Spherical | 40 | ca. 1 | Fe—Ni—Si | 65 | Spherical | 25 | ca. 1 | Fe—Co—Al | 70 | Fe—Co—Al—O phase as coating layer for second magnetic particles (of core-shell type) + PVB | 20 | 19 | <1 |
| Example 7-3 | Spherical | 40 | ca. 1 | Fe—Ni—Si | 77 | Spherical | 25 | ca. 1 | Fe—Co—Al | 70 | Fe—Co—Al—O phase as coating layer for second magnetic particles (of core-shell type) + PVB | 8 | 15 | <1 |

TABLE 1-continued

| | First Magnetic Particle | | | | | Second Magnetic Particle | | | | | | | Characteristics of Magnetic Material | |
|---|---|---|---|---|---|---|---|---|---|---|---|---|---|---|
| | Shape | Mean Particle Size (Spherical) Mean Height (Flat) (μm) | Mean Aspect Ratio | Composition | Volume Ratio VF1 (%) | Shape | Mean Particle Size (nm) | Mean Aspect Ratio | Composition | Volume Ratio VF2 (%) | Intervening Phase Intervening Phase Material and Form | Volume Ratio VF3 (%) | Real Part of Magnetic Permeability μ' (@10 MHz) | Magnetic Permeability Loss μ tan δ (%) (@10 MHz) |
| Example 8-1 | Spherical | 40 | ca. 1 | Fe—Co—Si | 60 | Spherical | 25 | ca. 1 | Fe—Co—Al | 70 | Fe—Co—Al—O phase as coating layer for second magnetic particles (of core-shell type) + PVB | 21 | 13 | <1 |
| Example 8-2 | Flat | 0.07 | 200 | Fe—Ni—Si | 60 | Spherical | 25 | ca. 1 | Fe—Co—Al | 70 | Fe—Co—Al—O phase as coating layer for second magnetic particles (of core-shell type) + PVB | 21 | 30 | <1 |
| Example 8-3 | Flat | 0.09 | 110 | Fe—Ni—Si | 60 | Spherical | 25 | ca. 1 | Fe—Co—Al | 70 | Fe—Co—Al—O phase as coating layer for second magnetic particles (of core-shell type) + PVB | 21 | 26 | <1 |
| Example 9 | Spherical | 40 | ca. 1 | Fe—Ni—Si | 60 | Spherical | 25 | ca. 1 | Fe—Co—Al | 70 | Fe—Ni—Si—O phase as coating layer for first magnetic particles + Fe—Co—Al—O phase as coating layer for second magnetic particles (of core-shell type) + PVB | 21 | 20 | <1 |
| Example 10-1 | Flat | 0.07 | 200 | Fe—Ni—Si | 60 | Spherical | 25 | ca. 1 | Fe—Co—Al | 70 | Fe—Ni—Si—O phase as coating layer for first magnetic particles + Fe—Co—Al—O phase as coating layer for second magnetic particles (of core-shell type) + PVB | 21 | 25 | <1 |
| Example 10-2 | Flat | 0.08 | 210 | Fe—Si—Cr | 60 | Spherical | 25 | ca. 1 | Fe—Co—Al | 70 | Fe—Cr—Si—O phase as coating layer for first magnetic particles + Fe—Co—Al—O phase as coating layer for second magnetic particles (of core-shell type) + PVB | 21 | 24 | <1 |
| Example 10-3 | Flat | 0.08 | 210 | Fe—Ni—Si | 60 | Spherical | 25 | ca. 1 | Fe—Co—Al | 55 | Fe—Ni—Si—O phase as coating layer for first magnetic particles + Fe—Co—Al—O phase as coating layer for second magnetic particles (of nanogranular type) + PVB | 15 | 23 | <1 |

TABLE 1-continued

| | First Magnetic Particle | | | | | Second Magnetic Particle | | | | | | | Characteristics of Magnetic Material | |
|---|---|---|---|---|---|---|---|---|---|---|---|---|---|---|
| | Shape | Mean Particle Size (Spherical) Mean Height (Flat) (μm) | Mean Aspect Ratio | Composition | Volume Ratio VF1 (%) | Shape | Mean Particle Size (nm) | Mean Aspect Ratio | Composition | Volume Ratio VF2 (%) | Intervening Phase Intervening Phase Material and Form | Volume Ratio VF3 (%) | Real Part of Magnetic Permeability μ' (@10 MHz) | Magnetic Permeability Loss μ tan δ (%) (@10 MHz) |
| Example 10-4 | Flat | 0.08 | 210 | Fe—Ni—Si | 60 | Spherical | 25 | ca. 1 | Fe—Co—Al | — | Reactant of Fe—Ni—Si—O phase as coating layer for first magnetic particles, Fe—Co—Al—O phase as coating layer for second magnetic particles and $B_2O_3$: Fe—Co—Ni—Al—Si—B—O | 11 | 21 | <1 |
| Example 11 | Flat | 0.08 | 210 | Fe—Ni—Si | 60 | Spherical | 25 | ca. 1 | Fe—Co—Al | 55 | Fe—Ni—Si—O phase as coating layer for first magnetic particles + Fe—Co—Al—O phase as coating layer for second magnetic particles (of nanogranular type) + PVB | 15 | 32 | <1 |
| Comparative Example 1-1 | — | — | — | — | — | Spherical | 25 | ca. 1 | Fe—Co—Al | — | PVB | — | 8 | <1 |
| Comparative Example 1-2 | Spherical | 40 | ca. 1 | Fe—Co—Al | — | — | — | — | — | — | PVB | — | 10 | <1 |
| Comparative Example 2-1 | — | — | — | — | — | Spherical | 25 | ca. 1 | Fe—Co—Al | 70 | Fe—Co—Al—O phase as coating layer for second magnetic particles (of core-shell type) + PVB | — | 11 | <1 |
| Comparative Example 2-2 | Spherical | 40 | ca. 1 | Fe—Ni—Si | — | — | — | — | — | — | Fe—Ni—Si—O phase as coating layer for first magnetic particles + PVB | — | 12 | <1 |

As is apparent from Table 1, Examples can provide magnetic materials that have high magnetic permeability and low magnetic permeability loss in high-frequency regions.

Next, examples equivalent to the second embodiment are described as Examples 12 through 14, and are compared with Comparative Example 3. Table 2 shows particle shapes, average particle heights, aspect ratios, compositions, and binders.

Example 12

In the same manner as in Example 10-3, core-shell FeSiCr flat anisotropic magnetic particles and a binder PVB are mixed well, to form a slurry. While a shear stress is applied by a doctor blade method, the slurry is turned into a solidified material in which the anisotropic magnetic particles are oriented. The molded solidified material is finely divided and granulated, to obtain oriented composite powder (magnetic parts). The magnetic parts are molded in a magnetic field, to achieve a single orientation and form a magnetic material to be evaluated.

Example 13

In the same manner as in Example 10-3, core-shell FeSiCr flat anisotropic magnetic particles and a binder PVB are mixed well, to form a slurry. In a magnetic field, the slurry is turned into a solidified material in which the anisotropic magnetic particles are oriented, while a shear stress is applied by a doctor blade method. The molded solidified material is finely divided and granulated, to obtain oriented composite powder (magnetic parts). The magnetic parts are molded in a magnetic field, to achieve a single orientation and form a magnetic material to be evaluated.

Example 14

In the same manner as in Example 10-3, core-shell FeSiCr flat anisotropic magnetic particles and a binder PVB are mixed well, to form a slurry. In a magnetic field, the slurry is turned into a solidified material in which the anisotropic magnetic particles are oriented, while a shear stress is applied by a doctor blade method. The molded solidified material is finely divided and granulated, to obtain oriented composite powder (magnetic parts). The magnetic parts are molded in a magnetic field. Further, this molded product is again subjected to compression molding with a metal mold having higher strength, to form a magnetic material to be evaluated.

Comparative Example 3

In the same manner as in Example 10-3, core-shell FeSiCr flat anisotropic magnetic particles and a binder PVB are mixed well, to form a slurry. While a shear stress is applied by a doctor blade method, molding is performed in a magnetic field, to form a magnetic material to be evaluated.

Of each material of Examples 12 through 14 and Comparative Example 1 to be evaluated, the real part of magnetic permeability (μ') and magnetic permeability loss (μ–tan δ=μ"/μ'×100(%)) are evaluated in the manner described below. The evaluation results are shown in Table 2.

Using an impedance analyzer, the magnetic permeability of each ring-like sample is measured. In the measurement, the real part μ' and the imaginary part μ" re measured at a frequency of 10 MHz. Magnetic permeability loss, μ–tan δ, is calculated by the formula, μ"/μ'×100(%).

TABLE 2

| | Particle | Mean Height | Aspect | | Binding | Molding Method | | | Characteristics of Magnetic Material: Real Part of Magnetic Permeability | Characteristics of Magnetic Material: Magnetic Permeability |
|---|---|---|---|---|---|---|---|---|---|---|
| | Shape | (μm) | Ratio | Composition | Material | First | Second | Third | μ' | Loss μ tan δ (%) |
| Example 12 | Flat | 0.08 | 210 | Fe—Si—Cr | PVB | Shear Stress | Magnetic Field | N/A | 32 | <1% |
| Example 13 | Flat | 0.08 | 210 | Fe—Si—Cr | PVB | Magnetic Field + Shear Stress | Magnetic Field | N/A | 37 | <1% |
| Example 14 | Flat | 0.08 | 210 | Fe—Si—Cr | PVB | Magnetic Field + Shear Stress | Magnetic Field | Recompression | 40 | <1% |
| Comparative Example 1 | Flat | 0.08 | 210 | Fe—Si—Cr | PVB | Magnetic Field + Shear Stress | N/A | N/A | 24 | <1% |

As is apparent from Table 2, Examples can provide magnetic materials that have high magnetic permeability and low magnetic permeability loss in high-frequency regions.

What is claimed is:

1. A magnetic material comprising:

a plurality of first magnetic particles comprising at least one magnetic metal selected from the group consisting of Fe, Co, and Ni, the first magnetic particles being 1 μm or greater in particle size and being 5 to 50 μm in average particle size;

a plurality of second magnetic particles comprising at least one magnetic metal selected from the group including consisting of Fe, Co, and Ni, the second magnetic particles being smaller than 1 μm in particle size and being 5 to 50 nm in average particle size; and an intermediate phase existing between the first magnetic particles and the second magnetic particles, wherein the intermediate phase coats at least part of the second magnetic particles, to form a composite particle, and wherein at least one of the following limitations a)-d) apply:

a) the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, and the intermediate phase comprises at least one of the nonmagnetic metals;

b) a volume ratio of the second magnetic particles to the composite particle is 40 to 80 volume percent;

c) a volume ratio of the composite particle to the first magnetic particles is 10 to 30 volume percent;

d) an atomic ratio of nonmagnetic metal to magnetic metal in the intermediate phase in the composite particle is higher than an atomic ratio of nonmagnetic metal to magnetic metal in the second magnetic particles, and oxygen content in the intermediate phase in the composite particle is larger than oxygen content in the second magnetic particles.

2. The magnetic material according to claim 1, wherein the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, and the intermediate phase comprises at least one of the nonmagnetic metals.

3. The magnetic material according to claim 2, wherein the composite particle is a core-shell particle in which each of the second magnetic particles has the intermediate phase as a coating layer.

4. The magnetic material according to claim 1, wherein a volume ratio of the first magnetic particles to the magnetic material is 30 to 80 volume percent.

5. The magnetic material according to claim 1, wherein a volume ratio of the second magnetic particles to the composite particle is 40 to 80 volume percent.

6. The magnetic material according to claim 1, wherein a volume ratio of the composite particle to the first magnetic particles is 10 to 30 volume percent.

7. The magnetic material according to claim 1, wherein a volume ratio of the second magnetic particles to the first magnetic particles is 4 to 30 volume percent.

8. The magnetic material according to claim 1, wherein an atomic ratio of nonmagnetic metal to magnetic metal in the intermediate phase in the composite particle is higher than an atomic ratio of nonmagnetic metal to magnetic metal in the second magnetic particles, and oxygen content in the intermediate phase in the composite particle is larger than oxygen content in the second magnetic particles.

9. A magnetic material comprising:

a plurality of magnetic particles comprising at least one magnetic metal selected from the group consisting of Fe, Co, and Ni; and an intermediate phase existing between the magnetic particles, wherein particle sizes of the magnetic particles exhibit a bimodal particle size distribution, a particle size corresponding to a first peak of the particle size distribution is 5 to 50 μm, and a particle size corresponding to a second peak of the particle size distribution is 5to 50nm, and wherein at least one of the following limitations a)-b) apply:

a) when particles having the particle size corresponding to the first peak of the bimodal particle size distribution are first magnetic particles, and particles having the particle size corresponding to the second peak of the bimodal particle size distribution are second magnetic particles, the intermediate phase coats at least part of the second magnetic particles, to form a composite particle;

b) the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, and the intermediate phase comprises at least one of the nonmagnetic metals.

10. The magnetic material according to claim 9, wherein when particles having the particle size corresponding to the first peak of the bimodal particle size distribution are first magnetic particles, and particles having the particle size corresponding to the second peak of the bimodal particle size distribution are second magnetic particles, the intermediate phase coats at least part of the second magnetic particles, to form a composite particle.

11. The magnetic material according to claim 9, wherein the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, and the intermediate phase comprises at least one of the nonmagnetic metals.

12. The magnetic material according to claim 10, wherein the composite particle is a core-shell particle in which each of the second magnetic particles has the intermediate phase as a coating layer.

13. The magnetic material according to claim 9, wherein a volume ratio of the first magnetic particles to the magnetic material is 30 to 80 volume percent.

14. A method of manufacturing a magnetic material, comprising:

synthesizing a plurality of first magnetic particles comprising at least one magnetic metal selected from the group consisting of Fe, Co, and Ni, the first magnetic particles being 5 to 50 μm in average particle size;

synthesizing a plurality of second magnetic particles comprising at least one magnetic metal selected from the group consisting of Fe, Co, and Ni, the second magnetic particles being 5 to 50 nm in average particle size;

synthesizing an intermediate phase;

forming a composite particle comprising the second magnetic particles and the intermediate phase, and mixing and molding the first magnetic particles and the composite particle wherein at least one of the following limitations a)-b) apply:

a) the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, the intermediate phase comprises at least one of the nonmagnetic metals, and the composite particle forms a core-shell particle in which at least part of the second magnetic particles is coated with the intermediate phase;

b) the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc,. V, Y, Nb, Pb, Cu, In, Sn, and a rare-earth element, the intermediate phase comprises at least one of the nonmagnetic metals, and the composite particle forms a nanogranular particle in which the second magnetic particles are coated with the intermediate phase.

15. The method of manufacturing a magnetic material according to claim 14, wherein the second magnetic particles comprise at least one nonmagnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, the intermediate phase comprises at least one of the nonmagnetic metals, and the composite particle forms a core-shell particle in which at least part of the second magnetic particles is coated with the intermediate phase.

16. The method of manufacturing a magnetic material according to claim 14, wherein the second magnetic particles comprise at least one non-magnetic metal selected from the group consisting of Mg, Al, Si, Ca, Zr, Ti, Hf, Zn, Mn, Ba, Sr, Cr, Mo, Ag, Ga, Sc, V, Y, Nb, Pb, Cu, In, Sn, and a rare-earth element, the intermediate phase comprises at least one of the non-magnetic metals, and the composite particle forms a nanogranular particle in which the second magnetic particles are coated with the intermediate phase.

17. An inductor element comprising the magnetic material according to claim 1.

* * * * *